United States Patent [19]

Raleigh

[11] Patent Number: 4,470,541

[45] Date of Patent: Sep. 11, 1984

[54] CONTROL SYSTEM FOR LOW MASS HYDRONIC BOILERS

[75] Inventor: William F. Raleigh, Valencia, Calif.

[73] Assignee: Teledyne Industries, Inc., Los Angeles, Calif.

[21] Appl. No.: 480,344

[22] Filed: Mar. 30, 1983

[51] Int. Cl.[3] ..... F25J 3/00; F22B 35/00; F23N 5/20; F24D 3/00

[52] U.S. Cl. ..... 236/21 B; 236/46 R; 237/8 R; 62/158

[58] Field of Search ..... 62/158; 236/21 B, 11, 236/9 A, 46 R; 237/8 R; 219/492, 493, 481

[56] References Cited

U.S. PATENT DOCUMENTS 2,081,831 5/1937 Moore ..... 237/8
2,155,890 4/1939 Campbell ..... 237/8 R X

*Primary Examiner*—William E. Wayner
*Assistant Examiner*—J. Sollecito
*Attorney, Agent, or Firm*—Reagin & King

[57] ABSTRACT

A control system for a low mass hydronic boiler is disclosed which includes a sensor for measuring the temperature of the fluid exiting the boiler. The level of fuel flow provided to the boiler is reduced when the water temperature exceeds a predetermined high temperature limit. The level of fuel flow provided to the boiler is increased only after the water temperature has decreased below a predetermined reset temperature limit and a predetermined interval of time has elapsed.

6 Claims, 2 Drawing Figures

CONTROL SYSTEM FOR LOW MASS HYDRONIC BOILERS

BACKGROUND OF THE INVENTION

This invention relates to boiler temperature control systems, and more particularly, to temperature control systems for low mass hydronic boilers.

Many prior art residential heating systems employ hydronic boilers to heat water or other fluid which is circulated to radiators positioned throughout the home. Recent advances in the field of hydronic heating systems have led to boiler designs which use heat exchangers having substantially less mass than those of prior designs.

One advantage of using low mass heat exchangers is a decrease in the thermal response time of the boiler, enabling the heating system to react more quickly to ambient temperature changes.

On the other hand, this same rapid response time complicates the control of the boiler. For example, it has been found that the outlet water temperature of the boiler may vary rapidly and may exceed safe temperature levels, especially when several of the radiators in the system are turned off.

Accordingly, it is an object of the present invention to provide a new and improved control system for low mass hydronic boilers.

It is another object of the present invention to safely and reliably limit the outlet water temperature of a low mass hydronic boiler.

SUMMARY OF THE INVENTION

The foregoing and other objects of the invention are accomplished by a control system which includes a sensor for measuring the temperature of the fluid exiting the boiler. A first comparator responsive to the sensor provides a first comparison signal when the fluid temperature exceeds a predetermined high temperature limit.

A second comparator responsive to the sensor provides a second comparison signal when the fluid temperature is less than a predetermined reset temperature limit. A timer is initiated by the first comparison signal and provides a timer signal after a predetermined interval has elapsed. A latch circuit is used to control the boiler fuel valve to provide a reduced level of fuel flow in response to the first comparison signal, and to control the boiler fuel valve to provide an increased level of fuel flow when both the timer signal and the second comparison signal are provided.

Other objects, features, and advantages of the invention will become apparent from a reading of the specification when taken in conjunction with the drawings, in which like elements are referred to by like reference designations throughout the several views.

DESCRIPTION OF THE PREFERRED EMBODIMENT

Figure 1:
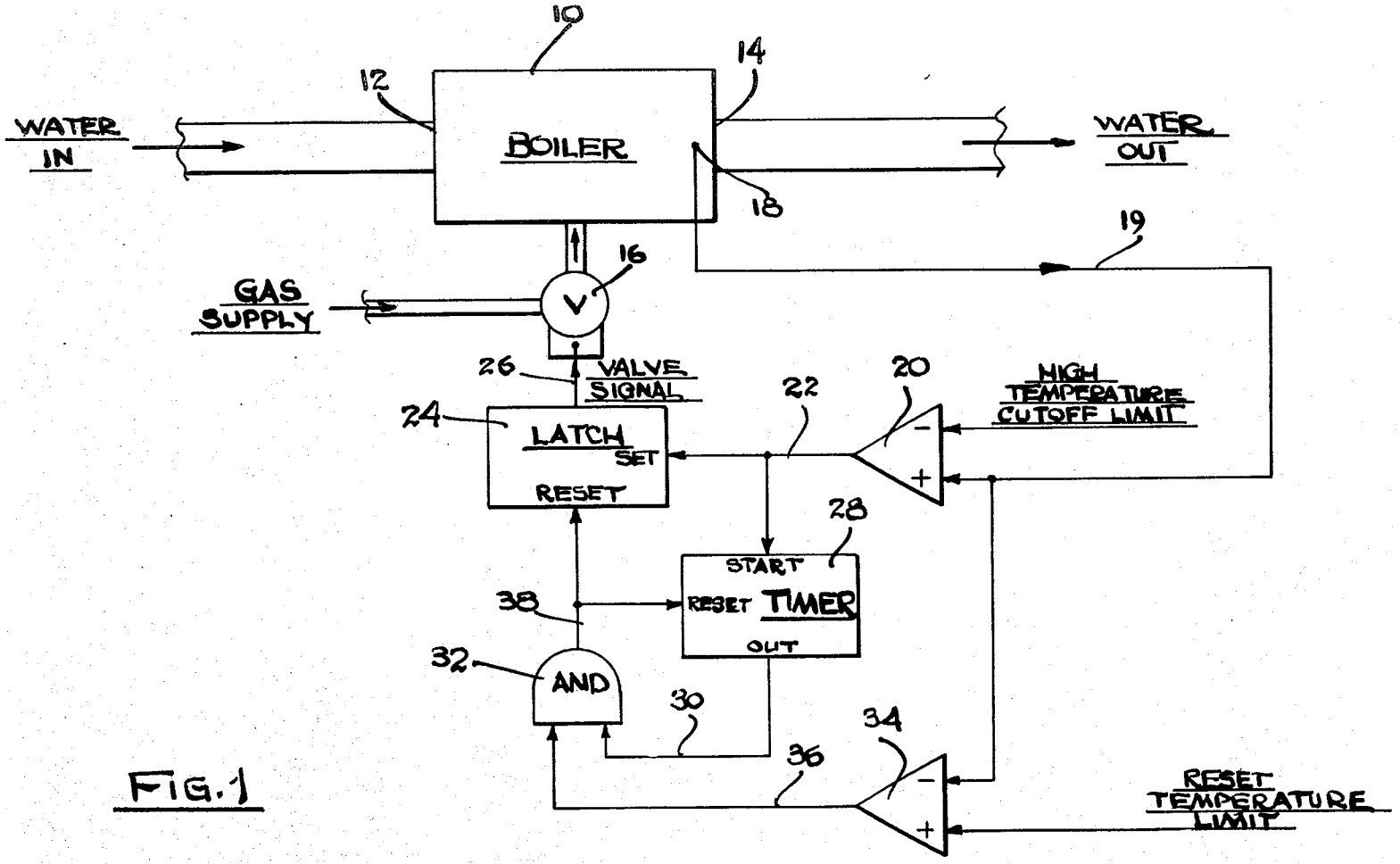
FIG. 1 is a block diagram showing one embodiment of the control system of the present invention used to limit the outlet water temperature in a low mass hydronic boiler.

Referring to FIG. 1, there is shown a hydronic boiler 10 designed having a low mass heat exchanger (not shown) and a water inlet 12 and outlet 14. Water is circulated through the boiler 10 and through a plurality of controllable radiators (not shown) which are distributed throughout a residence to provide a source of heat. A source of fuel such as natural gas is provided to the boiler 10 through a valve 16 which is designed to control the level of fuel flow to the boiler 10 which in turn determines the rate of heating of the water.

A temperature sensor 18 is provided adjacent the outlet 14 to measure the temperature of the water exiting the heater. An output signal from the sensor 18 is provided on a line 19 to a positive input terminal of a first comparator 20. A signal representing a predetermined high temperature cutoff limit is provided to a negative input terminal of the comparator 20.

The comparator 20 provides a first comparator signal on line 22 when the temperature of the water exiting the heater exceeds the high temperature cutoff limit.

The first comparator signal on the line 22 is provided to a set input of a latch 24. When the latch 24 is set, a first valve signal is provided on line 26 to the valve 16. The first valve signal causes the valve 16 to reduce the level of gas flow provided to the boiler 10 to a first predetermined level which permits the temperature of the water exiting the heater to drop below the high temperature cutoff limit.

Returning to FIG. 1, the first comparator signal on the line 22 is provided as a start signal to a start input terminal of a timer circuit 28. The timer 28 is designed to provide a timer signal on line 30 after a predetermined interval of time has elapsed from the time at which the start signal is provided. The timer signal is provided to one input terminal of an AND gate 32.

The output signal from the sensor 18 is provided to a negative input terminal of a second comparator 34. A signal representing a predetermined reset temperature limit, which is less than the high temperature cutoff limit is provided to a positive input terminal of the comparator 34. The comparator 34 provides a second comparator signal on line 36 when the temperature of the water exiting the heater is less than the reset temperature limit. The second comparator signal on the line 36 is provided to a second input terminal of the AND gate 32.

The gate 32 provides a reset signal on line 38 which is provided to a reset terminal of the latch 24 and to a reset terminal of the timer 28. The reset signal resets the latch 24, which causes it to provide a second valve signal on the line 26. The second valve signal in turn causes the valve 16 to increase the level of gas flow provided to the boiler 10 to a second predetermined level which is greater than the first predetermined level. The reset signal also serves to reset the timer 28 so that it may respond to the signal appearing at its start terminal. Both the latch 24 and the tinmer 28 are designed to switch to their respective reset conditions when operating power is first applied to the control system.

The operation of the control system described above is as follows. When operating power is first applied to the control system, the latch 24 and the timer 28 are reset, whereby the timer signal is not provided on the line 30, and the second valve signal is provided on the line 26. The second valve signal causes the valve 16 to provide the second predetermined level of gas flow to the boiler 10. This level of gas flow is designed to enable the boiler 10 to heat the water flowing through it sufficiently to provide the desired heating effect in a residential heating system.

It is envisioned that a thermostat (not shown) responsive to ambient temperature would be used in conjunction with the control system of the present invention to regulate the air temperature of the area being heated. For example, a thermostat in the form of a normally closed switch may be inserted in series with the line 26 from the latch 24 to the valve 16. When the desired air temperature is achieved, the thermostat opens, removing the valve signal from the valve 16, which in turn causes the valve to shut off or reduce the flow of gas to the boiler 10.

During the operation of the boiler 10, the temperature of the water exiting the boiler normally does not exceed the high temperature cutoff limit. However, should the user decide to shut off several of the radiators in the heating system, the fast thermal response of the low mass heat exchanger of the boiler 10 may cause the temperature of the water exiting the boiler to exceed the high temperature cutoff limit. In a preferred embodiment of the invention, the high temperature cutoff limit is set to approximately 200° F.

If the temperature of the water as measured by sensor 18 exceeds the high temperature cutoff limit, comparator 20 provides the first comparison signal on the line 22. This signal switches the latch 24 to the set mode, causing the first valve signal on the line 26 to be provided to the valve 16. The first valve signal causes the valve 16 to reduce the flow of gas provided to the boiler 10 to a first predetermined level which is less than the second predetermined level. In one embodiment of the invention, the first predetermined level is set to one-half of the second predetermined level of gas flow, while in another embodiment of the invention, the first predetermined level is set to zero. In either event, the first predetermined level of gas flow is set sufficiently low to permit the water exiting the boiler 10 to cool below the reset temperature limit, which is in turn set below the high temperature cutoff limit. In a preferred embodiment of the invention the reset temperature limit is set approximately 15° F. below the high temperature cutoff limit.

When the first comparator signal is provided on the line 22, the timer 28 is started. The timer 28 does not provide the timer signal on the line 30 until a predetermined interval of time has elapsed. In a preferred embodiment of the invention, the predetermined interval is set at approximately three minutes. Accordingly, should the temperature of the water exiting the boiler 10 drop below the reset temperature limit before the predetermined interval has elapsed, the latch 24 remains in the set mode and prevents the boiler from returning to the heating level determined by the second valve signal. This is so because the latch 24 is reset by the AND gate 32 only when both the timer signal and the second comparator signal are provided on the lines 30 and 36 respectively. Thus, the boiler 10 will be returned to the heating level determined by the second valve signal only when the water exiting the heater has cooled below the reset temperature limit and the predetermined interval of time has elapsed from the time at which the water temperature exceeded the high temperature cutoff limit. When the latch 24 is reset, the timer 28 is also reset so that it may respond to a new start signal if the water temperature again exceeds the high temperature cutoff limit.

From the above discussion, it may be seen that the control system of the present invention requires that both time and temperature criteria be met before the boiler 10 is returned to the heating level determined by the second valve signal. This feature of the invention prevents the boiler 10 from rapidly cycling between high and low heating levels. Such rapid cycling could occur because the low mass of the heat exchanger of the boiler 10 permits rapid heating and cooling of the water exiting the boiler 10 in response to increases and decreases in the level of gas flow to the boiler. However, the control system of the present invention limits the cycling rate of the boiler 10 between high and low heating levels to the rate set by the timer 28. Thus, in the preferred embodiment, the boiler 10 cannot cycle between heating levels any more frequently than once every three minutes.

Figure 2:
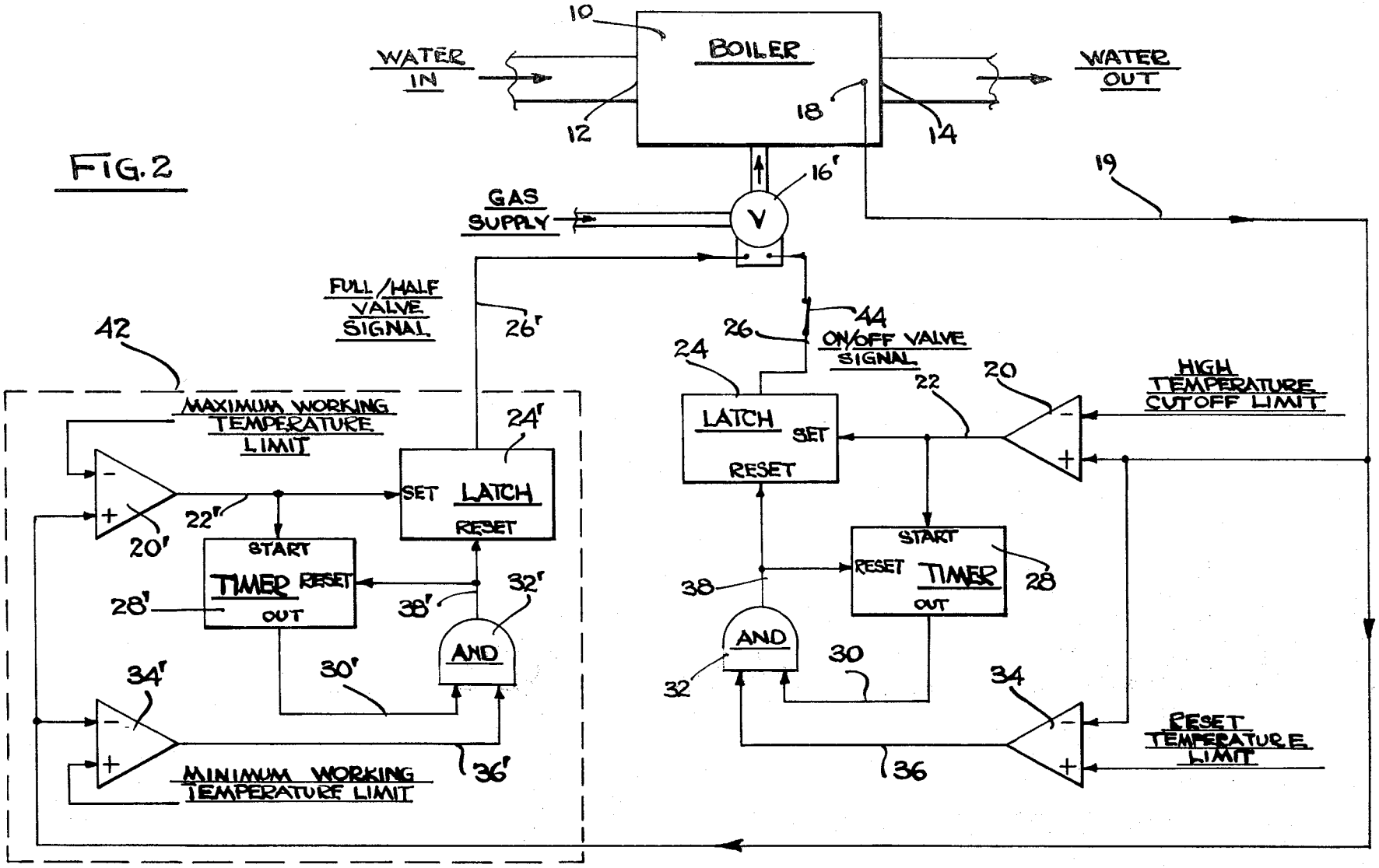
FIG. 2 is a block diagram showing another embodiment of the control system of the present invention used in conjunction with a two-stage gas valve both to limit the outlet water temperature in a the low mass hydronic boiler and to control the working temperature limits of the water.

Referring to FIG. 2, there is shown an alternate embodiment of the invention used in conjunction with a two-stage fuel valve 16' to control the operation of the boiler 10. The control system shown in FIG. 2 is similar in construction to the control system of FIG. 1 with the addition of the elements shown within dotted line 42. Further, it will be appreciated that the elements within the dotted line 42 form a replica of the control system of FIG. 1, where the elements designated by the primed reference numerals correspond, respectively, to like elements designated by the unprimed numerals.

A signal representing a maximum working temperature limit is provided to a negative input terminal of comparator 20', and a signal representing a minimum working temperature limit is provided to a positive input terminal of comparator 34'. The maximum and minimum working temperature limits define the desired temperature range for the water flowing through the boiler 10 during normal operation. The maximum working temperature limit is preferably set below the reset temperature limit described above. In a preferred embodiment, the maximum working temperature limit is set at 180° F., and the minimum working temperature limit is set at 165° F.

Referring to the elements within the dotted line 42 of FIG. 2, and recalling the analysis of the control system of FIG. 1, it will be understood that when the water temperature (as sensed by sensor 18) exceeds the maximum working temperature limit, a signal from comparator 20' appears on the line 22' and acts to set latch 24'. This same signal acts to start timer 28'. It will also be understood that if the interval of time determined by the timer 28' has elapsed and the water temperature has dropped below the minimum working temperature limit, a signal will appear on the line 38' which resets the latch 24'.

The latch 24' provides signals on line 26' to the two-stage fuel valve 16'. The valve 16' is designed to provide fuel, such as gas, to the burners of the boiler 10 at either a maximum level of flow (hereinafter referred to as full flow rate), or a reduced level of flow (hereinafter referred to as half flow rate). The valve 16' is also used to shutoff the flow of gas to the burner.

Referring to FIG. 2, the valve 16' is provided with an on/off signal on the line 26 from the latch 24, and with a full/half signal on the line 26' from the latch 24'. When the latch 24 is set, the signal appearing on the line 26

(previously defined as the first valve signal in the embodiment of FIG. 1) causes the valve 16' to shutoff. As described above for the previous embodiment, a thermostat in the form of a normally closed switch 44 is provided in series with the line 26 and is used to shutoff valve 16' when the desired ambient temperature is achieved.

When the latch 24 is reset, the signal appearing on the line 26 (previously defined as the second valve signal in the embodiment of FIG. 1) causes the valve 16' to turn on and to furnish fuel at a rate determined by the signal appearing on the line 26'. When the latch 24' is set, the signal appearing on the line 26' enables the valve 16' to provide fuel at half flow rate; and when the latch 24' is reset, the signal appearing on the line 26' enables the valve 16' to provide fuel at full flow rate.

The operation of the control system of FIG. 2 is as follows. When operating power is first applied to the control system, latches 24 and 24', and timers 28 and 28' are reset, whereby the valve 16' is turned on and set to provide full gas flow to boiler 10. This gas flow rate causes the boiler 10 to rapidly heat the water to the maximum working temperature limit. At that point, the latch 24' is set, which causes the valve 16' to reduce gas flow to half rate, thus allowing the water to cool. In addition, the timer 28' is started. If the water temperature remains between the maximum and minimum working temperature limits, the latch 24' remains set, and the boiler 10 continues to fire at half rate.

Should the water temperature drop below the minimum working temperature limit before the timer 28' has completed its timing interval (typically set at three minutes), the latch 24' remains set and the boiler 10 remains firing at half rate. However, after the timing interval has elapsed, water temperature below the minimum working temperature limit causes the latch 24' to reset, whereby the valve 16' increases gas flow to full rate, causing the water temperature to rapidly increase. It should be noted that when the ambient temperature has reached the desired limit as sensed by the thermostat, the switch 44 opens, causing the valve 16' to shutoff fuel flow.

If, during the operation of the boiler 10, the water temperature should exceed the high temperature cutoff limit, the control system comprising the elements 20, 22, 24, 28, 32 and 34 controls the operation of the boiler in the manner previously described for the embodiment of FIG. 1. Thus, in such instance, the latch 24 is set, causing the valve 16' to shutoff gas flow. Gas flow is reestablished only after the water temperature has cooled below the reset temperature limit and the interval of time determined by the timer 28 has elapsed.

From the above description it may be seen that the control system of FIG. 2 provides complete control of the water temperature during normal operation and during periods of high temperature excursions. In addition, the control system prevents the occurrence of rapid changes in fuel flow level.

While there have been shown and described preferred embodiments, it is to be understood that various other adaptions and modifications may be made within the spirit and scope of the invention. It is thus intended that the invention be limited in scope only by the appended claims.

What is claimed is:

1. A control system for a hydronic boiler used to heat a fluid and having a fluid inlet and outlet to permit the fluid to enter and exit the boiler and valve means for controlling the level of fuel flow available to heat the fluid, the system comprising:

means for measuring the temperature of the fluid exiting the boiler;

means for decreasing the level of fuel flow used to heat the fluid to a first predetermined level when the water temperature of the fluid exiting the boiler exceeds a predetermined high temperature cutoff limit;

means for providing a timer signal after a predetermined interval has elapsed from the time at which the level of fuel flow is decreased to the first predetermined level; and means for increasing the level of fuel flow used to heat the fluid to a second predetermined level if the timer signal is provided and if the water temperature of the fluid exiting the boiler is less than a predetermined reset temperature limit which is less than the predetermined high temperature cutoff limit.

2. The control system of claim 1 further including:

means for decreasing the level of fuel flow used to heat the fluid to a third predetermined level which is less than the second predetermined level when the water temperature of the fluid exiting the boiler exceeds a predetermined maximum working temperature limit which is less than the predetermined high temperature cutoff limit;

means for providing a second timer signal after a second predetermined interval has elapsed from the time at which the level of fuel flow is decreased to the third predetermined level; and means for increasing the level of fuel flow used to heat the fluid to the second predetermined level if the second timer signal is provided and if the water temperature of the fluid exiting the boiler is less than a predetermined minimum working temperature limit which is less than the predetermined maximum working temperature limit.

3. A control system for a hydronic boiler used to heat a fluid and having a fluid inlet and outlet to permit the fluid to enter and exit the boiler and valve means, for controlling the level of fuel flow available to heat the fluid, the system comprising:

sensor means for measuring the temperature of the fluid exiting the boiler;

first comparator means responsive to the sensor means for providing a first comparison signal when the temperature of the fluid exiting the boiler exceeds a predetermined high temperature cutoff limit;

second comparator means responsive to the sensor means for providing a second comparison signal when the temperature of the fluid exiting the boiler is less than a predetermined reset temperature limit which is less than the predetermined high temperature cutoff limit;

timer means responsive to the first comparison signal for providing a timer signal after a predetermined interval has elapsed from the time at which the first comparison signal is provided;

logic means for providing a logic signal when both the second comparison signal and the timer signal are provided; and latch means for controlling the valve means to provide a first predetermined level of fuel flow to heat the fluid when the first comparison signal is provided, and to provide a second predetermined level of fuel flow to heat the fluid when the logic signal is provided, where the second predetermined level is greater than the first predetermined level.

4. The control system of claim 3 further including:

third comparator means responsive to the sensor means for providing a third comparison signal when the temperature of the fluid exiting the boiler exceeds a predetermined maximum working temperature limit;

fourth comparator means responsive to the sensor means for providing a fourth comparison signal when the temperature of the fluid exiting the boiler is less than a predetermined minimum working temperature limit which is less than the predetermined maximum working temperature limit;

second timer means responsive to the third comparison signal for providing a second timer signal after as second predetermined interval has elapsed from the time at which the third comparison signal is provided;

second logic means for providing a second logic signal when both the fourth comparison signal and the second timer signal are provided; and second latch means for controlling the valve means to provide a third predetermined level of fule flow to heat the fluid when the third comparsion signal is provided, and to provide the second predetermined level of fuel flow to heat the fluid when the second logic signal is provided, where the third predetermined level is less than the second predetermined level.

5. A method of controlling a hydronic boiler used to heat a fluid and having a fluid inlet and outlet to permit the fluid to enter and exit the boiler and valve means for controlling the level of fuel flow available to heat the fluid, the method comprising the steps of:

measuring the temperature of the fluid exiting the boiler;

comparing the measured temperature to a predetermined high temperature cutoff limit;

reducing the level of fuel flow available to heat the fluid to a first predetermined level if the measured temperature exceeds the high temperature cutoff limit;

measuring a predetermined interval of time beginning when the measured temperature exceeds the high temperature cutoff limit;

comparing the measured temperature to a predetermined reset temperature limit which is less than the high temperature cutoff limit; and increasing the level of fuel flow available to heat the fluid to a second predetermined level greater than the first predetermined level if the predetermined interval of time has expired and if the measured temperature is less than the predetermined reset temperature limit.

6. The method of claim 5 further including the steps of:

comparing the measured temperature to a predetermined maximum working temperature limit;

reducing the level of fuel flow available to heat the fluid to a third predetermined level which is less than the second predetermined level if the measured temperature exceeds the maximum working temperature limit;

measuring a second predetermined interval of time beginning when the measured temperature exceeds the maximum working temperature limit;

comparing the measured temperature to a predetermined minimum working temperature limit which is less than the maximum working temperature limit; and increasing the level of fuel flow available to heat the fluid to the second predetermined level if the second predetermined interval of time has expired and if the measured temperature is less than the predetermined minimum working temperature limit.

* * * * *